US006026970A

United States Patent [19]

Sturm, Jr. et al.

[11] Patent Number: 6,026,970

[45] Date of Patent: Feb. 22, 2000

[54] TELESCOPING TUBE ASSEMBLY

[75] Inventors: Albert J. Sturm, Jr., Stillwater; Fred W. Hanson, White Bear Lake, both of Minn.

[73] Assignee: Par Systems, Inc., Shoreview, Minn.

[21] Appl. No.: 09/266,673

[22] Filed: Mar. 11, 1999

[51] Int. Cl.[7] ..... B66C 23/04

[52] U.S. Cl. ..... 212/348; 52/118; 74/89.15

[58] Field of Search ..... 212/348, 350, 212/230, 264, 231, 296; 52/118; 74/89.15

[56] References Cited

U.S. PATENT DOCUMENTS

| | | | |
|---|---|---|---|
| Re. 31,627 | 7/1984 | Evans | 74/89.15 |
| 4,000,661 | 1/1977 | Menzel | 74/89.15 |
| 4,298,128 | 11/1981 | Gattu | 212/267 |
| 4,337,868 | 7/1982 | Gattu | 212/267 |
| 4,396,126 | 8/1983 | Moravec | 212/348 |
| 4,635,491 | 1/1987 | Yamano et al. | 74/89.15 |
| 4,793,187 | 12/1988 | Petrovsky | 74/89.15 |
| 5,377,096 | 3/1998 | Van Doren et al. | 212/348 |
| 5,937,699 | 8/1999 | Garrec | 74/89.15 |

*Primary Examiner*—Thomas J. Brahan
*Attorney, Agent, or Firm*—Westman, Champlin & Kelly, P.A.; S. Koehler

[57] ABSTRACT

A telescoping tube assembly includes a first longitudinal tube section and a second longitudinal tube section disposed within the first longitudinal tube section and adapted for telescoping motion into and out of the first longitudinal tube section. A third longitudinal tube section is disposed within the second longitudinal tube section and is adapted for telescoping motion into and out of the second longitudinal tube section. A drive motor is joined to the second longitudinal tube section to move therewith and operates a first ball-screw assembly and a second ball-screw assembly. The first ball-screw assembly is operatively connected between the first longitudinal tube section and the second longitudinal tube section. The second ball-screw assembly is operatively connected between the second longitudinal tube section and the third longitudinal tube section.

7 Claims, 6 Drawing Sheets

TELESCOPING TUBE ASSEMBLY

BACKGROUND OF THE INVENTION

The present invention relates to a telescoping tube assembly. More particularly, the present invention relates to a telescoping tube assembly having tube sections that extend and retract in equal displacements relative to each other in the telescoping process.

Telescoping tube assemblies such as disclosed in U.S. Pat. No. 5,465,854 are known. Generally, the telescoping tube assembly disclosed in this patent includes a first longitudinal tube section attached to a mounting platform and a second longitudinal section that telescopes relative to the first longitudinal tube section. Additional tube sections can be disposed within each other and within the second longitudinal tube section. Each longitudinal tube section includes a rigid support plate with a U-shaped housing having two spaced-apart longitudinal edges, which attach to the corresponding rigid support plate. Between each longitudinal section are linear bearings or wheels, which allow for the telescopic movement.

In one embodiment, the telescoping tube assembly operates vertically in that the longitudinal tube sections extend and retract downwardly from the first longitudinal tube section. The telescoping action is produced by four drums of effective differing diameters, wherein each drum has a drive cable wrapped therearound with each drive cable being attached to a different longitudinal tube section. The drive cables and varying diameter drums result in retraction and extension of the telescoping sections in equal amounts relative to each other. However, a disadvantage of the above-described assembly is that the use of drive cables limits operation to vertical deployment since the cables can not operate in compression, but only in tension.

In many applications, such as lifting or milling operations, it is necessary that the telescoping tube assembly be able to operate in the presence of compression and tension forces. Drive assemblies have been advanced for telescoping tubes or cranes that used elongated hydraulic cylinder units to extend and retract individual sections. However, as the telescopic assembly increases in size and weight and in the number of moveable sections, the size, weight, number and complexity of hydraulic cylinders increases accordingly. Similarly, other telescopic drive assemblies have used ball-screw assemblies to extend and retract each of the sections, but the size, weight, number and complexity of ball-screw assemblies also increases with the number of moveable sections.

There is thus an ongoing need to provide improved means to operate telescoping tube assemblies.

SUMMARY OF THE INVENTION

A telescoping tube assembly includes a first longitudinal tube section and a second longitudinal tube section disposed within the first longitudinal tube section and adapted for telescoping motion into and out of the first longitudinal tube section. A third longitudinal tube section is disposed within the second longitudinal tube section and is adapted for telescoping motion into and out of the second longitudinal tube section. A drive motor is joined to the second longitudinal tube section to move therewith and operates a first ball-screw assembly and a second ball-screw assembly. The first ball-screw assembly is operatively connected between the first longitudinal tube section and the second longitudinal tube section. The second ball-screw assembly is operatively connected between the second longitudinal tube section and the third longitudinal tube section.

DETAILED DESCRIPTION OF THE PREFERRED EMBODIMENTS

Figure 1:
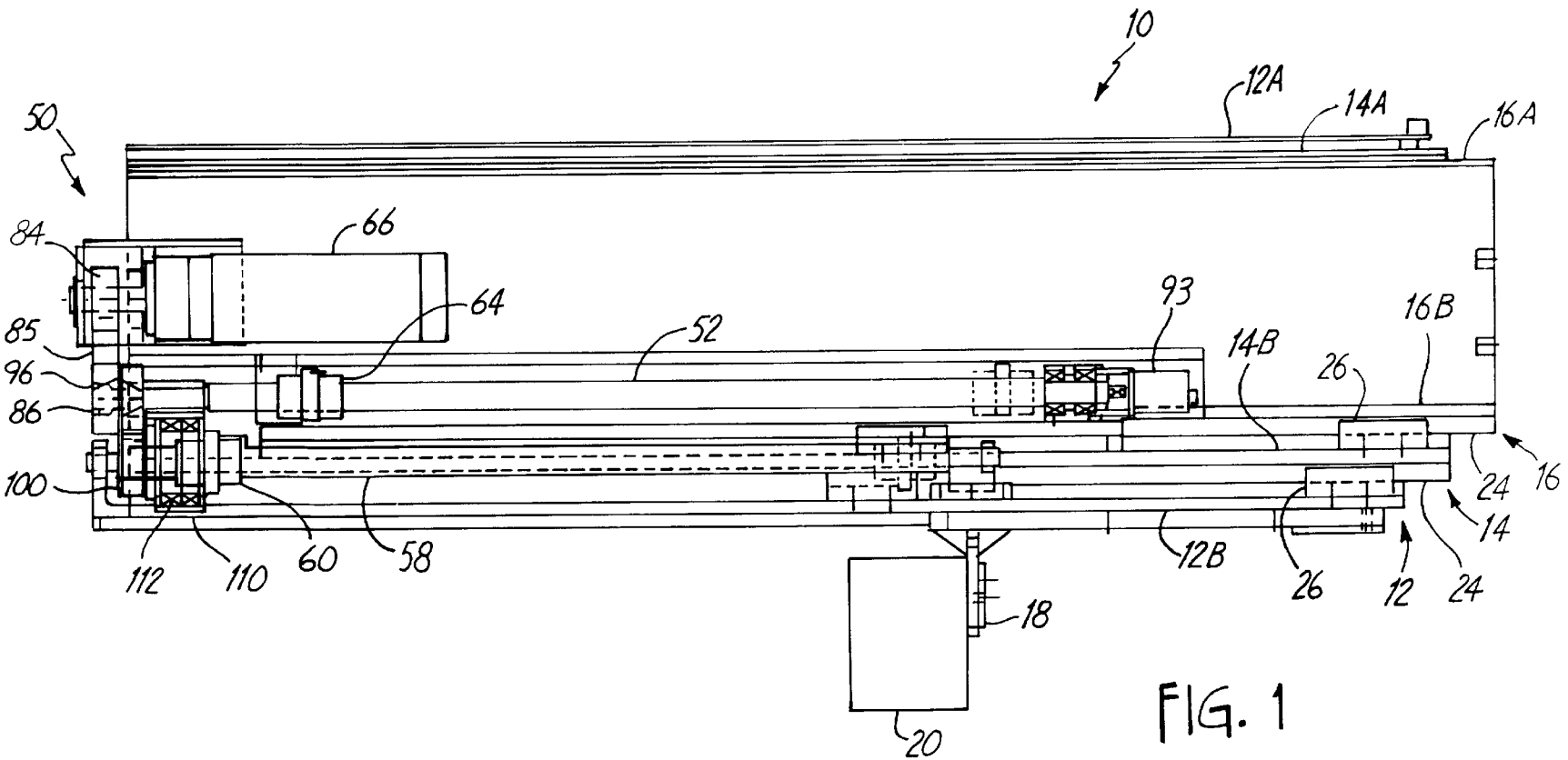
FIG. 1 is a sectional view of a telescoping tube assembly of the present invention in a retracted position.

A preferred embodiment of a telescoping tube assembly 10 is illustrated in FIG. 1. The telescoping tube assembly 10 is made up of three longitudinal tube sections 12, 14 and 16. The outer-most longitudinal tube section 12 includes a mounting bracket 18 for mounting the telescoping tube assembly 10 to a fixed structure or a moveable trunnion schematically illustrated at 20. Each of the two succeeding tube sections 14 and 16 are moveable such that each extends and retracts from within the larger preceding section in a telescoping manner. Specifically, the second longitudinal tube section 14 extends and retracts from within the longitudinal tube section 12; and the longitudinal tube section 16 extends and retracts from within the telescoping tube section 14.

In the embodiment illustrated, the longitudinal tube sections 12, 14, and 16 and the means for allowing relative displacement are constructed in accordance with U.S. Pat. No. 5,465,854, which is hereby incorporated by reference in its entirety. Generally, each of the tube sections 12, 14, and 16 include a relatively thin "U" or similar shaped housing 12A, 14A, and 16A joined to a thicker support plate 12B, 14B and 16B, respectively. The thicker support plates 12B, 14B and 16B, although sufficiently rigid for compression and tension loading, are inherently weak to torsion bending. The thin housings 12A, 14A and 16A provide a load path for shear loads in order to increase rigidity. When the longitudinal tube sections 12, 14 and 16 are fully extended, the tube sections overlap thereby allowing transfer of forces through the support plates 12B, 14B, and 16B.

Figure 3:
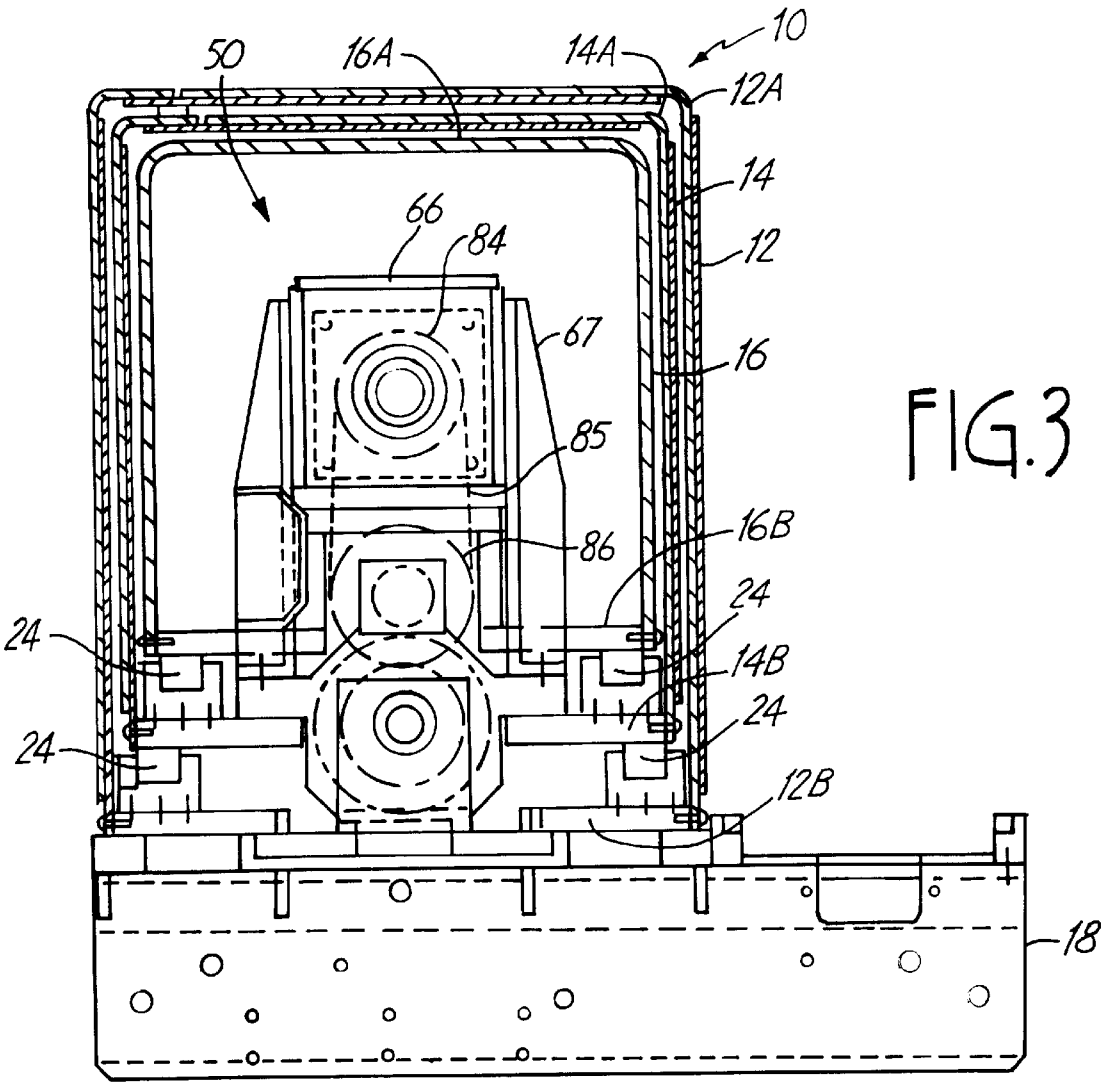
FIG. 3 is a front elevational view of the telescoping tube assembly.
Figure 4:
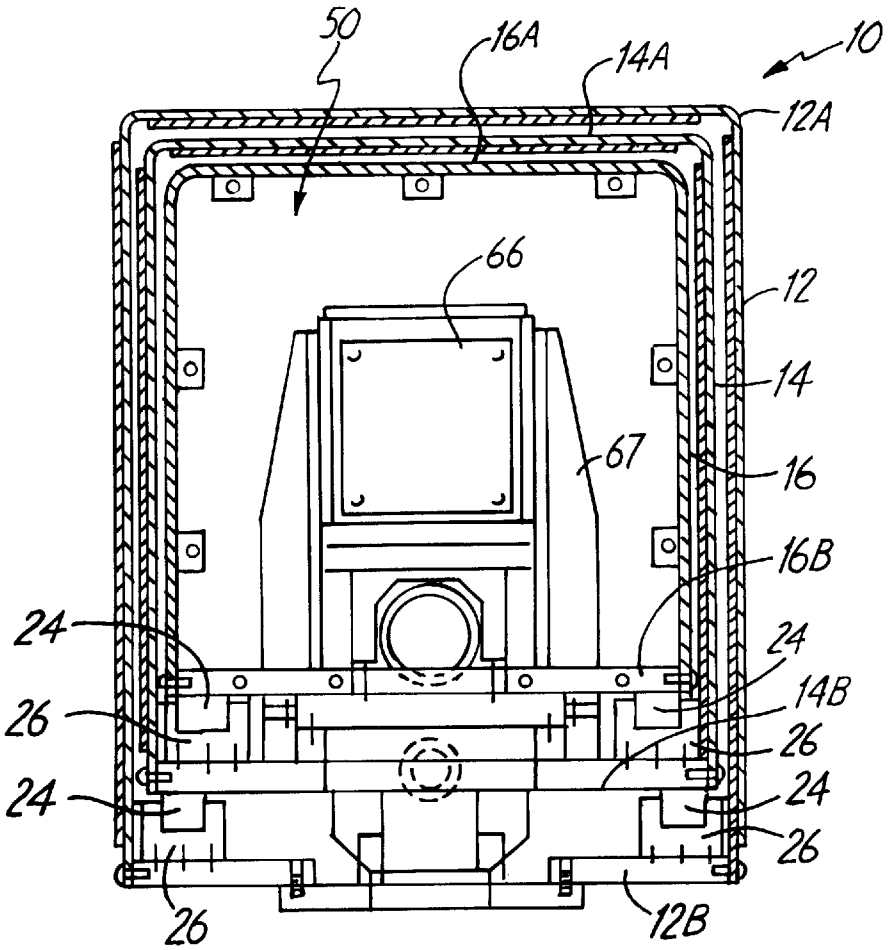
FIG. 4 is a rear elevational view of the telescoping tube assembly.
Figure 5:
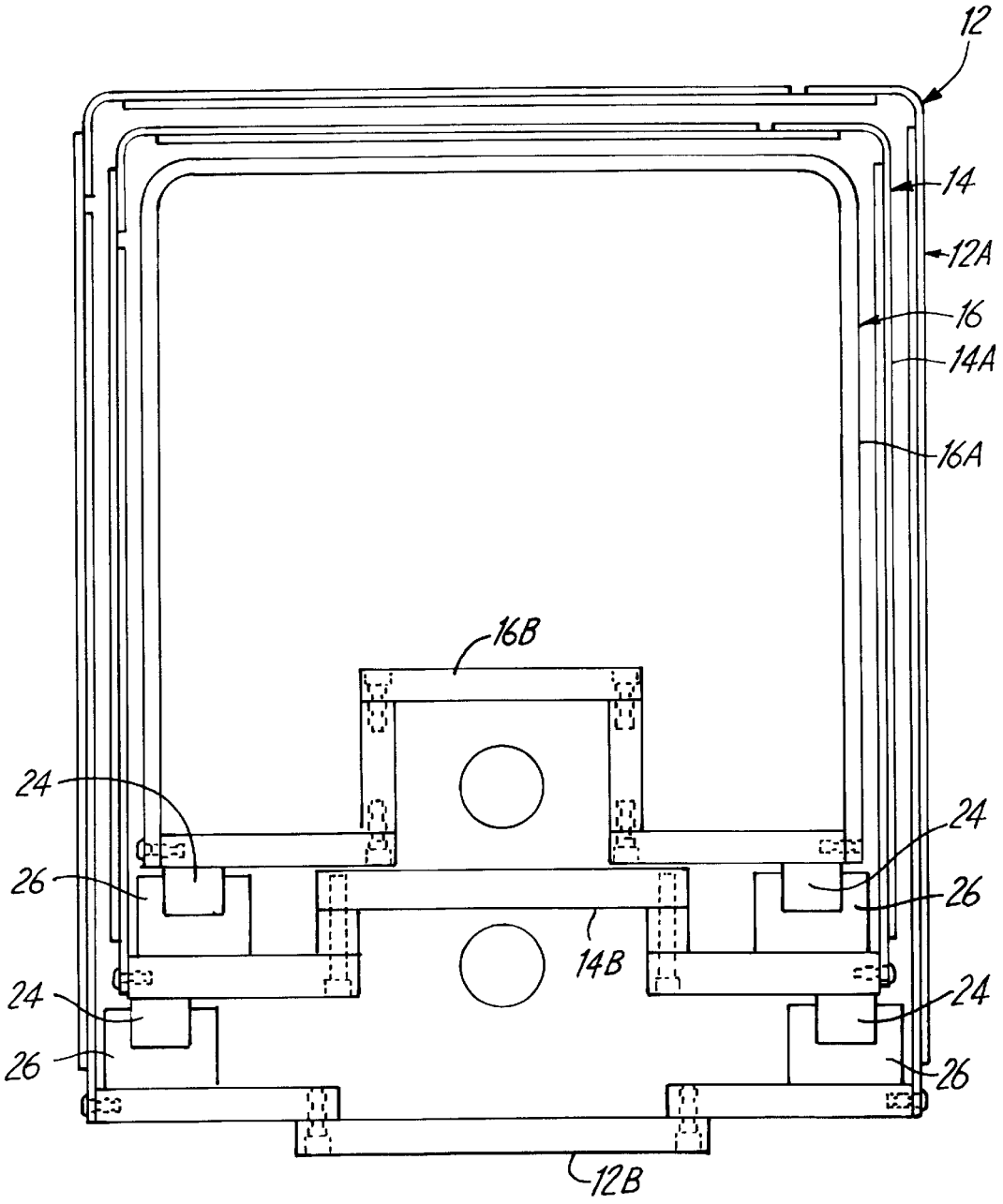
FIG. 5 is a front elevational view of nested tube sections.

Referring to FIGS. 3 and 4, two parallel linear bearing tracks 24 are joined to the support plates 14B and 16B. The linear bearing tracks 24 are attached on the opposite side of the support plates 14B and 16B as the housing 14A and 16A, while linear bearings 26 engage the tracks 24 in a conventional manner to maintain the position of the support plates 12B, 14B, and 16B, and the tube sections 12, 14, and 16, relative to each other and parallel during extension and retraction. The linear bearings 26 are also joined to the support plates 12B and 14B.

It should be understood that the linear bearing tracks 24 and the linear bearings 26 are but one type of device to allow displacement of the tube sections 12, 14, and 16 relative to each other. As appreciated by those skilled in the art, other types of guiding devices such as rollers, slides, etc. can be used in place of or in addition to the linear bearing tracks 24 and linear bearings 26. Similarly, it is not necessary to limit use of the guiding devices to only between the support plates 12B, 14B, and 16B. Rather, guiding devices can be arranged to engage the housings 12A, 14A and 16A, if desired. In addition, the present invention is not limited to telescoping tube sections comprising a thicker support plate and thin housings, but can also be incorporated into telescoping tube assemblies having longitudinal tube sections of other designs.

As appreciated by those skilled in the art, the trunnion 20 allows tilting and rotation of the telescoping tube assembly 10 to any desired position for deployment. Typically, hydraulic actuators, not shown, and not forming part of the present invention, are conventionally connected between the tube section 12 and the trunnion 20 or other fixed support to provide tilting functions.

A drive assembly 50 selectively extends and retracts the tube sections 12, 14, and 16 relative to each other. Preferably, the tube sections 14 and 16 are extended and retracted in equal increments thereby exposing substantially the same length of each section during deployment. In other words, if tube section 14 is extended one foot relative to tube section 12, then tube section 16 is also extended one foot relative to tube section 14. In this manner, overall rigidity of the telescoping tube assembly 10 is maintained at maximum capability for any position of extension.

Figure 6:
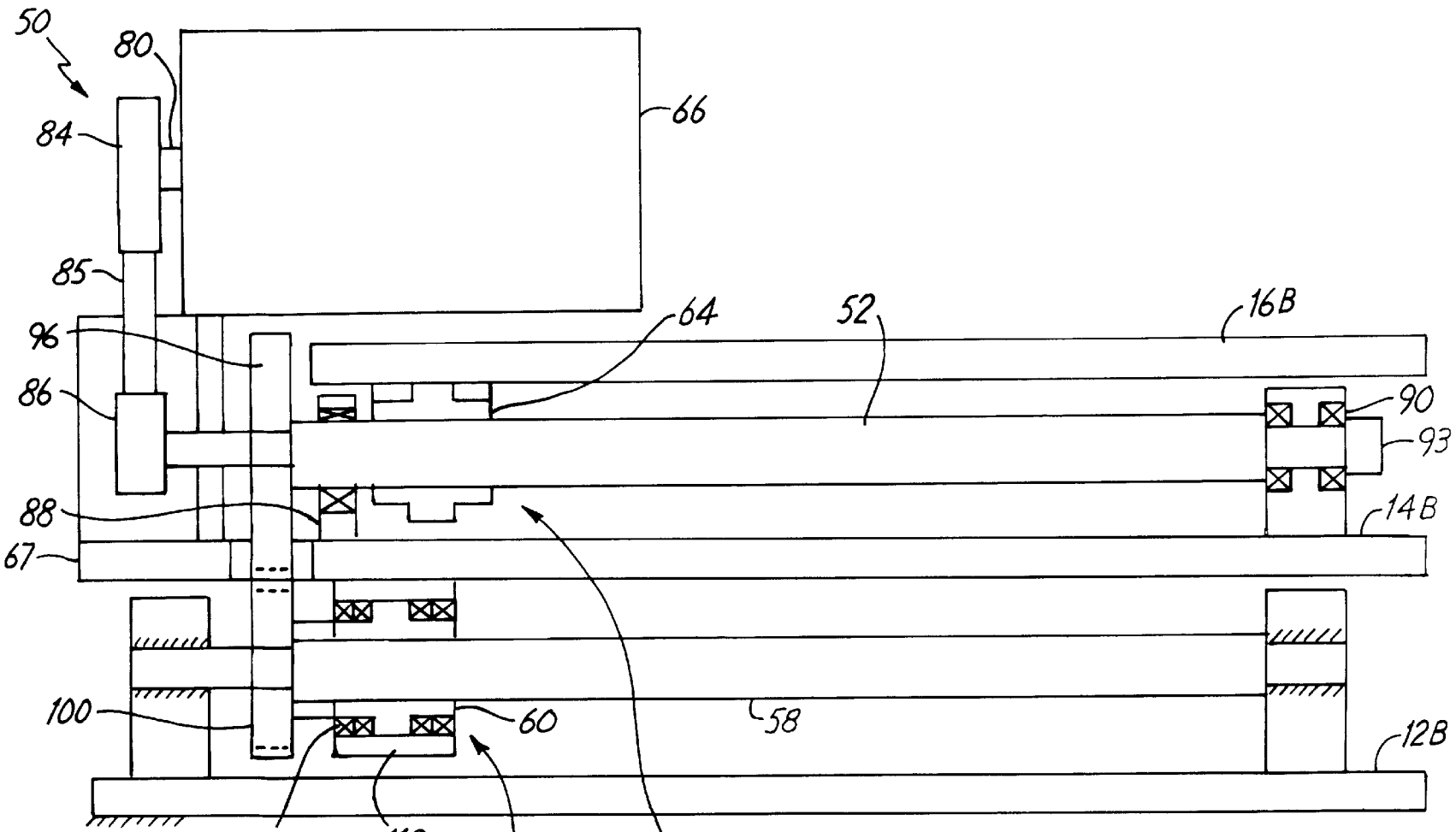
FIG. 6 is a schematic illustration of a drive assembly.

To accomplish equal, incremental extension and retraction of the tube sections, the drive assembly 50 includes ball-screw assemblies 54 and 56. The schematic illustration of FIG. 6 is provided to clearly illustrate components of the drive assembly 50, wherein the tube sections 12 14 and 16 are represented by support plates 12B, 14B and 16B. The same reference numbers are used in FIGS. 1–5 to identify like components. Generally, the ball-screw assembly 54 includes an elongated threaded screw 58 that is rigidly and non-rotatably joined to the support plate 12B, and a ball-screw nut 60 that is rotatable on the screw 58 but is joined to the support plate 14B to move therewith.

Figure 2:
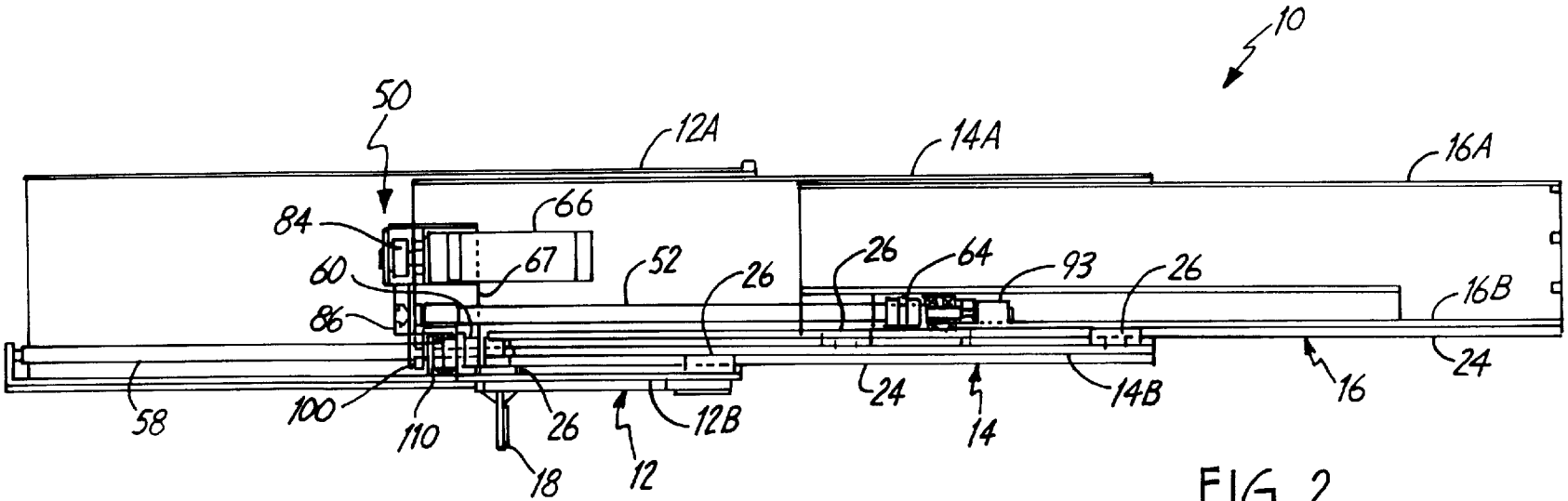
FIG. 2 is a sectional view of the telescoping tube assembly in an extended position.

The ball-screw assembly 56 operates in a manner opposite to that of ball-screw assembly 54 to cause relative displacement between tube sections 14 and 16. Specifically, the ball-screw assembly 56 includes a rotatable elongated threaded screw 52 that is joined to the support plate 14B to move therewith, and a ball-screw nut 64 that is non-rotatable but fixed to the support plate 16B to move therewith. A drive motor 66, such as an electric motor or hydraulic motor, is operatively connected to the nut 60 and the screw 52 in order to cause simultaneous rotation thereof, which, in turn, causes simultaneous extension or retraction of the tube sections 14 and 16. It should be noted that the drive motor 66 is mounted to the support plate 14B with a mounting bracket 67 to move therewith, as also illustrated in FIG. 2.

In the embodiment illustrated, an output shaft 80 of the motor 66 is equipped with a pulley 84. An endless flexible member 85, such as a belt, couples pulley 84 to a pulley 86 joined to the screw 52. Rotation of the screw 52 advances the nut 64 in order to cause relative displacement of support plate 16B with respect to the support plate 14B. Support hearings 88 and 90 join the screw 52 to the support plate 14B and allow rotation thereof. Feedback indicating the extent of deployment of the tube assembly 10 is provided by a resolver 93 coupled to the end of screw 52.

A gear 96 is also joined to the screw 52 and is in meshing engagement with a gear 100 that is rotatable about screw 58. In particular, the gear 100 is coupled to the nut 60. A support housing 110 is joined to the support plate 14B and includes bearings 112 to allow rotation of the nut 60.

It should be understood that the use of pulleys 84 and 86, belt 85 and gears 96 and 100 are but one embodiment for causing rotation of the screw 52 and the nut 60. Other drive components can also be used. For instance, the pulleys 84 and 86 and the belt 85 can be replaced with a third gear that meshes with the gear 96. Likewise, individual pulleys and belts can be provided for the screw 52 and the nut 60. However, the gears 96 and 100 are a particularly efficient mechanism for transferring torque from the screw 52 to the nut 60, while use of the pulleys 84 and 86 and the belt 85 allow the drive assembly 50 to be efficiently packaged on the end of the tube assembly 10 wherein the drive motor 66 extends into the tube section 16. As appreciated by those skilled in the art, the pulleys 84 and 86 and belt 85 can be replaced with suitable gears and a chain.

In summary, the present invention provides a compact telescoping tube assembly that operates in the presence of compression and tension forces using only two ball-screw assemblies 54 and 56 and a single drive motor 66. In this manner, the number of components is reduced thereby reducing the weight and size of the drive assembly 50. By mounting the motor 66 to the intermediate tube section 14 to move therewith, only a single motor 66 is required.

Although the present invention has been described with reference to preferred embodiments, workers skilled in the art will recognize that changes may be made in form and detail without departing from the spirit and scope of the invention.

What is claimed is:

1. A telescoping tube assembly comprising:

a first longitudinal tube section;

a second longitudinal tube section disposed within the first longitudinal tube section and adapted for telescoping motion into and out of the first longitudinal tube section;

a third longitudinal tube section disposed within the second longitudinal tube section and adapted for telescoping motion into and out of the second longitudinal tube section;

a drive assembly comprising:

a first threaded screw joined to the first longitudinal tube section;

a first nut joined to the second longitudinal tube section to move therewith and operably coupled to the threads of the first threaded screw;

a second threaded screw joined to the second longitudinal tube section to move therewith;

a second nut joined to the third longitudinal tube section to move therewith and operably coupled to the threads of the second threaded screw; and a drive motor joined to the second longitudinal tube section to move therewith and to rotate the first nut and the second threaded screw.

2. The telescoping tube assembly of claim 1 wherein the drive motor is an electric motor.

3. The telescoping tube assembly of claim 1 wherein the drive motor is a hydraulic motor.

4. The telescoping tube assembly of claim 1 and further comprising an endless flexible member coupling the drive motor to the second threaded screw.

5. The telescoping tube assembly of claim 2 and further comprising:

a first gear joined to the second threaded screw to rotate therewith; and a second gear joined to the first nut to rotate therewith, the second gear being in meshing engagement with the first gear.

6. The telescoping tube assembly of claim 5 and further comprising:

a first pulley joined to an output shaft of the drive motor to rotate therewith;

a second pulley joined to the second threaded screw to rotate therewith; and wherein the endless flexible member is a belt.

7. The telescoping tube assembly of claim 1 wherein the first threaded screw is non-rotatable.

* * * * *